US009335022B2

(12) United States Patent
Lee

(10) Patent No.: US 9,335,022 B2
(45) Date of Patent: May 10, 2016

(54) AUTOMOTIVE LAMP MODULE COMPRISING LASER DIODE AND HEAT SINKS

(71) Applicant: HYUNDAI MOBIS CO., LTD., Seoul (KR)

(72) Inventor: Tae Won Lee, Yongin-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 38 days.

(21) Appl. No.: 14/170,264

(22) Filed: Jan. 31, 2014

(65) Prior Publication Data

US 2014/0293631 A1 Oct. 2, 2014

(30) Foreign Application Priority Data

Mar. 28, 2013 (KR) ..... 10-2013-0033607

(51) Int. Cl.
*F21S 8/10* (2006.01)

(52) U.S. Cl.
CPC ..... *F21S 48/328* (2013.01); *F21S 48/1104* (2013.01); *F21S 48/119* (2013.01); *F21S 48/1145* (2013.01); *F21S 48/1208* (2013.01); *F21S 48/211* (2013.01); *F21S 48/214* (2013.01); *F21S 48/2206* (2013.01)

(58) Field of Classification Search
CPC ..... F21K 9/56
USPC ..... 362/294, 373, 218
See application file for complete search history.

(56) References Cited

U.S. PATENT DOCUMENTS

| | | | | |
|---|---|---|---|---|
| 9,057,512 | B2 * | 6/2015 | En et al. | |
| 2009/0116251 | A1 * | 5/2009 | Harbers et al. | 362/373 |
| 2011/0215701 | A1 * | 9/2011 | Tong et al. | 313/46 |

FOREIGN PATENT DOCUMENTS

| | | | |
|---|---|---|---|
| CN | 101842630 | A | 9/2010 |
| JP | 2010-165834 | A | 7/2010 |

OTHER PUBLICATIONS

Chinese Office Action dated Dec. 22, 2015 of corresponding Chinese Patent Application No. 201410068179.4—7 pages.

* cited by examiner

*Primary Examiner* — Robert May
(74) *Attorney, Agent, or Firm* — Knobbe Martens Olson & Bear LLP

(57) ABSTRACT

An automotive lamp module includes a laser diode, a substrate with the laser diode on the top, a lower heat sink coupled to the bottom of the substrate, an upper heat sink coupled to the top of the substrate and having a light channel disposed through the upper heat sink and in which the laser diode is inserted, and a phosphor disposed in the light channel. Accordingly, it is possible to provide a simple configuration and a compact size and to effectively dissipate heat generated from the laser diode.

8 Claims, 5 Drawing Sheets

AUTOMOTIVE LAMP MODULE COMPRISING LASER DIODE AND HEAT SINKS

CROSS-REFERENCE TO RELATED APPLICATIONS

This application claims priority to and the benefit of Korean Patent Application No. 10-2013-0033607 filed in the Korean Intellectual Property Office on Mar. 28, 2013, the entire content of which is incorporated herein by reference.

BACKGROUND

1. Field

The described technology relates to an automotive lamp module.

2. Description of the Related Art

LEDs (Light Emitting Diode) or light bulbs are generally used as the light sources of automotive lamps. Recently, there has been an effort to use laser diodes for the automotive light sources, but an efficient technology has not been proposed up to now.

Presently, laser diodes are generally used in the medical and industrial fields. The laser diode (LD), a general term of lightwave oscillators and amplifiers using stimulated emission of photons by optical transition of electrons in semiconductors, has two electrodes. The laser diodes have the advantages that they are small in size and light in various lasers and can be manufactured in large quantities at low costs through semiconductor processes.

However, the laser diodes that are under development now for automotive lamp modules have a problem in that they are difficult to use for vehicles, because the structures are complicated and the heat sinks for heat dissipation are large in size.

SUMMARY

The described technology provides an automotive lamp module that uses a laser diode and has a simple structure and a compact size.

The described technology also provides an automotive lamp module that can effectively dissipate heat generated by a laser diode.

An embodiment of the present invention provides an automotive lamp module including: a laser diode; a substrate with the laser diode on the top; a lower heat sink coupled to the bottom of the substrate; an upper heat sink coupled to the top of the substrate and having a light channel disposed through the upper heat sink and in which the laser diode is inserted; and a phosphor disposed in the light channel.

A collimator may be disposed between the laser diode and the phosphor in the light channel.

The automotive lamp module may further include a phosphor holder coupled to the top of the upper heat sink and fixing the phosphor to the upper heat sink.

The phosphor holder may have a slit portion having a slit and covering the light channel and fastening portions extending from the slit portion.

The lower portion of the light channel may be a holder fixing the laser diode.

The substrate may include: a substrate body having a power supply circuit pattern on the top, which electrically connects a connector with a contact point of the laser diode; a first heat conduction layer disposed at the region except for the power supply circuit patter on the top of the substrate body; and a second heat conduction layer disposed on the bottom of the substrate body, in which at least one heat transfer hole may be disposed through the first heat conduction layer, the substrate body, and the second heat conduction layer.

The contact point of the laser diode may be disposed at the center of the substrate body and the connector may be positioned at the center portion of any one of the longitudinal and transverse sides of the substrate body.

A connector seat, which is a recess where the connector is inserted when the substrate and the upper heat sink are combined, may be disposed on the bottom of the upper heat sink.

According to embodiments of the present invention, it is possible to simplify the configuration and provide a compact size by fastening the collimator, the phosphor, and the phosphor holder to the upper heat sink and the lower heat sink covering the laser diode.

According to embodiments of the present invention, it is possible to effectively dissipating heat generated by the laser diode by fastening the upper heat sink and the lower heat sink to the top and the bottom of the substrate mounted with a laser diode. In particular, since the top and the bottom of the substrate to be mounted with a laser diode are plated with copper and the heat transfer holes are disposed through them, it is possible to more effectively dissipate heat by connecting the upper heat sink and the lower heat sink so that they can transmit heat, in addition to fixing the laser diode and supplying power.

The foregoing summary is illustrative only and is not intended to be in any way limiting. In addition to the illustrative aspects, embodiments, and features described above, further aspects, embodiments, and features will become apparent by reference to the drawings and the following detailed description.

Figure 1:
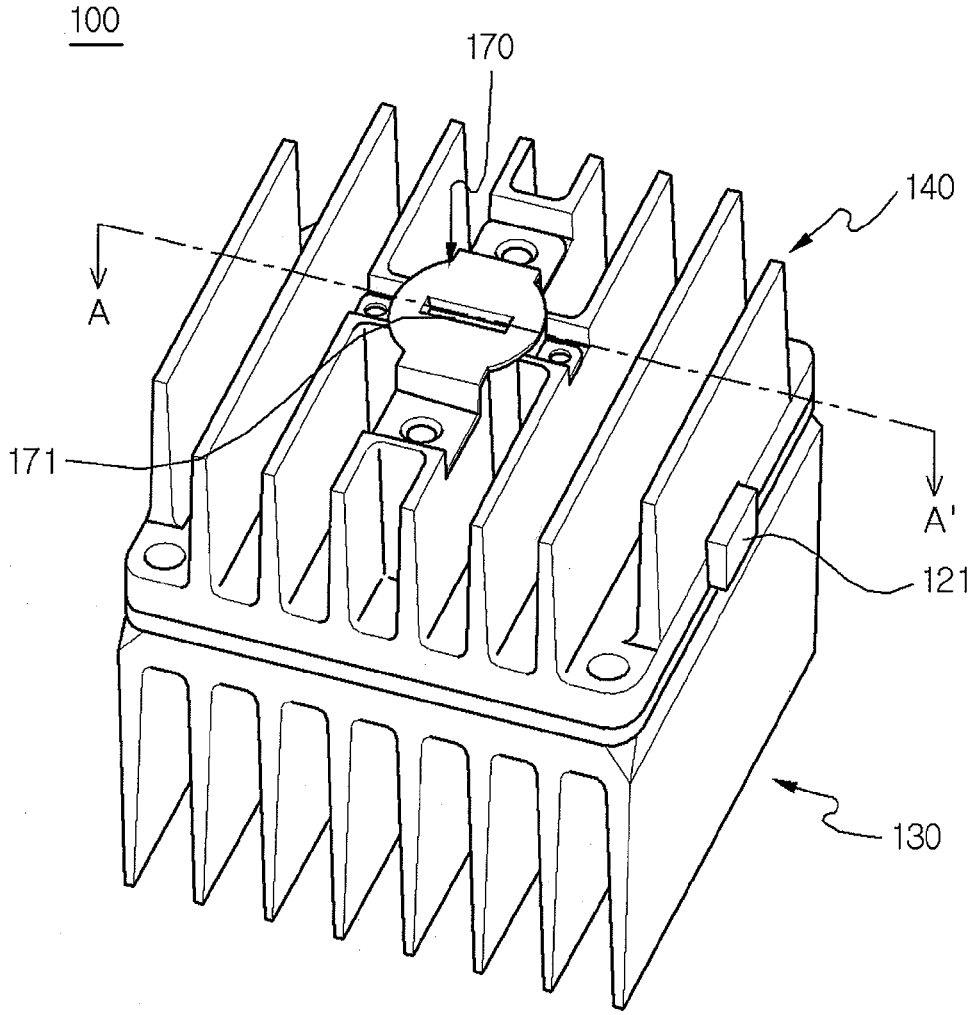
FIG. 1 is a view illustrating an automotive lamp module according to an embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter, embodiments of the present invention will be described in detail with reference to the accompanying drawings. First, in the specification, in giving reference numerals to components throughout the drawings, it should be noted that like reference numerals designate like components even though the components are illustrated in different drawings. Although embodiments of the present invention will be described hereafter, the spirit of the present invention is not limited thereto and may be modified and implemented in various ways by those skilled in the art.

Figure 2:
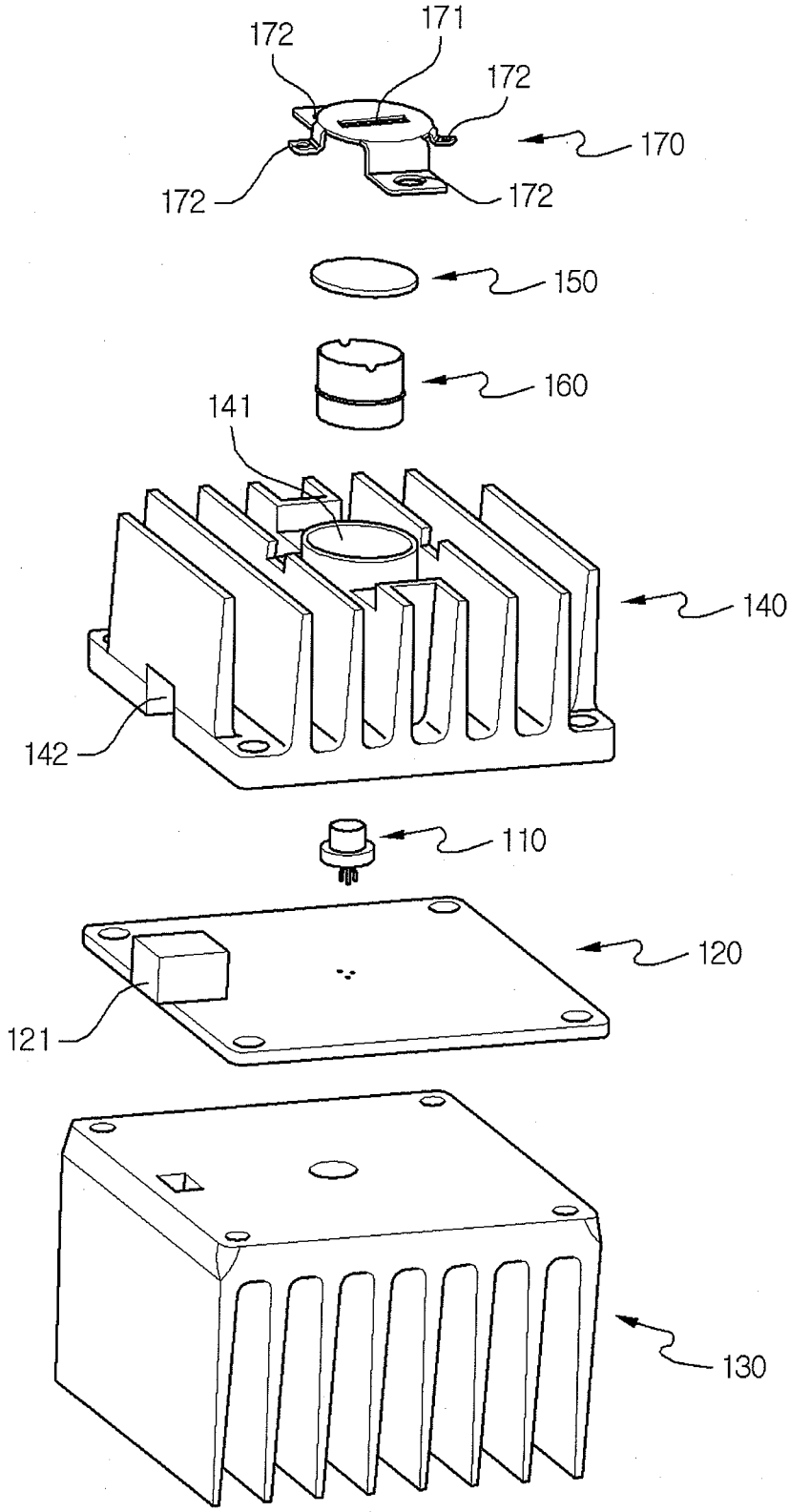
FIG. 2 is an exploded view of the automotive lamp module of FIG. 1.

FIG. 1 is a view illustrating an automotive lamp module according to an embodiment of the present invention and FIG. 2 is an exploded view of the automotive lamp module of FIG. 1.

FIGS. 1 and 2 illustrates only main characteristic parts for conceptually clear understanding of the present invention, so various modifications are expected in the figures and the scope of the present invention is not limited to the specific shapes illustrated in the figures.

Referring to FIGS. 1 and 2, an automotive lamp module 100 according to an embodiment of the present invention may include a laser diode 110, a substrate 120, a lower heat sink 130, an upper heat sink 140, a phosphor 150, a collimator 160, and a phosphor holder 170.

The laser diode 110 is mounted on the top of the substrate 120. The lower heat sink 130 is coupled to the bottom of the substrate 120 and the upper heat sink 140 is coupled to the top of the substrate 120. The collimator 160, the phosphor 150, and the phosphor holder 170 may be disposed on the upper heat sink 140.

The substrate 120 supplies power to the laser diode 110 and allows the upper heat sink 140 and the lower heat sink 130 to transmit heat.

Figure 3:
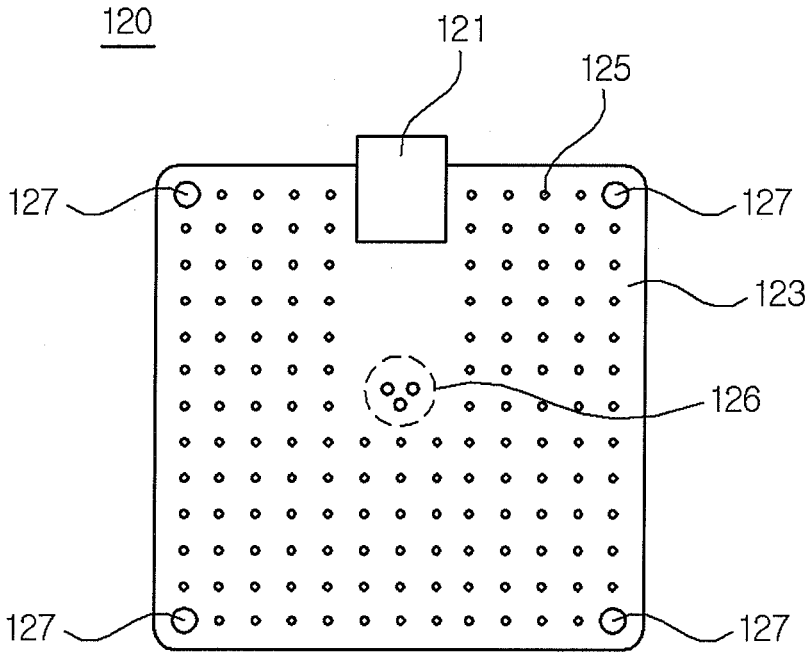
FIG. 3 is a view illustrating the top of the substrate of FIG. 1.
Figure 4:
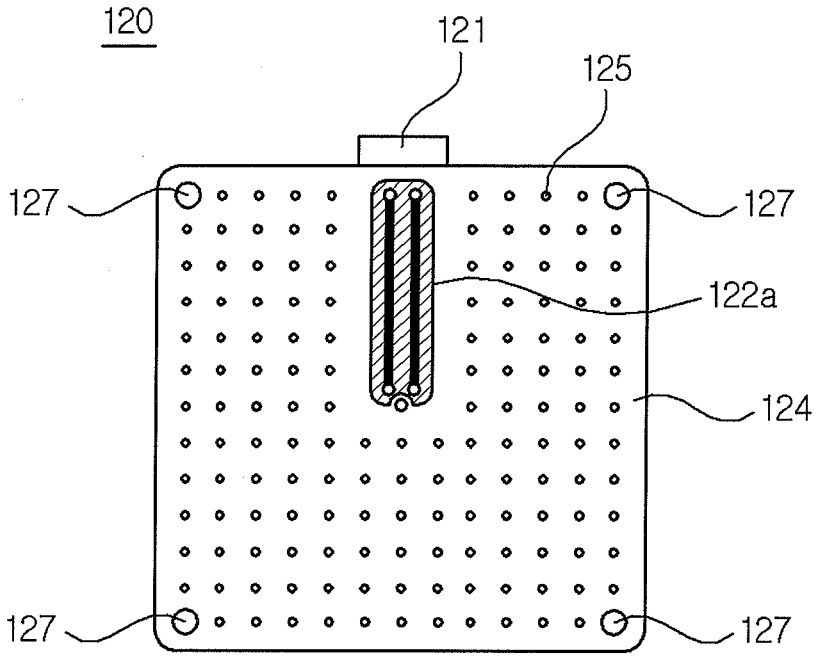
FIG. 4 is a view illustrating the bottom of the substrate of FIG. 1.
Figure 5:
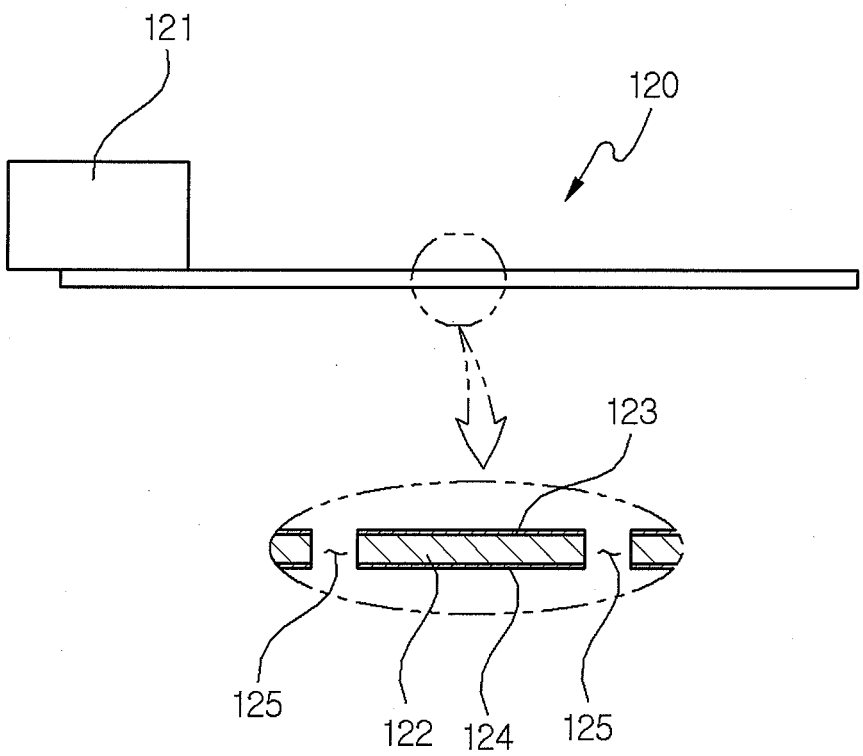
FIG. 5 is an enlarged view illustrating a cross-section of the substrate of FIG. 1.

FIG. 3 is a view illustrating the top of the substrate of FIG. 1, FIG. 4 is a view illustrating the bottom of the substrate of FIG. 1, and FIG. 5 is an enlarged view illustrating a cross-section of the substrate of FIG. 1.

Referring to FIGS. 3 to 5, the substrate 120 may include a substrate body 122, a first heat conduction layer 123 disposed on the top of the substrate body 122, and a second heat conduction layer 124 disposed on the bottom of the substrate body 122. A seat 126 where the laser diode 110 is mounted may be disposed at the center of the substrate 120.

A power supply circuit pattern 122*a* is disposed on the bottom of the substrate body 122. The power supply circuit pattern 122*a* electrically connects a connector 121 with the contact point of the laser diode 110 on the seat 126. The connector 121 may be positioned close to the center of any one of the longitudinal and transverse sides of the substrate body 122. Accordingly, the power supply circuit pattern 122*a* may be elongated from the center of the substrate body 122 to the center portion of any one of the longitudinal and transverse sides of the substrate body 122.

The first heat conduction layer 123 may be formed by plating the entire top of the substrate body 122 with copper. The second heat conduction layer 124 may be formed by plating the other region except for the power supply circuit pattern 122*a* of the bottom of the substrate body 122 with copper. The first heat conduction layer 123 and the second heat conduction layer 124 effectively transmit heat generated by the laser diode 110 to the upper heat sink 140 or the lower heat sink 130 in order to dissipate the heat.

In particular, heat transfer holes 125 may be disposed through the substrate 120, the first heat conduction layer 123, and the second heat conduction layer 124 and increases the effect of heat dissipation by allowing heat to transfer from the upper heat sink 140 to the lower heat sink 130 or from the lower heat sink 130 to the upper heat sink 140.

A plurality of heat transfer holes 125 may be arranged longitudinally or transversely.

The substrate 120, unlike the existing substrates for the laser diode 110, connects the upper heat sink 140 with the lower heat sink 130 so that they can transmit heat, in addition to fixing the laser diode 110 and supplying power.

On the other hand, fastening holes 127 for coupling the upper heat sink 140 and the lower heat sink 130 may be disposed at the corners of the substrate 120. It is possible to fasten the substrate 120, the lower heat sink 130, and the upper heat sink 140 by inserting fasteners such as bolts into the fastening holes 127.

The lower heat sink 130 is fastened to the bottom of the substrate 120 and dissipates heat generated by the laser diode 110 to the outside.

Figure 6:
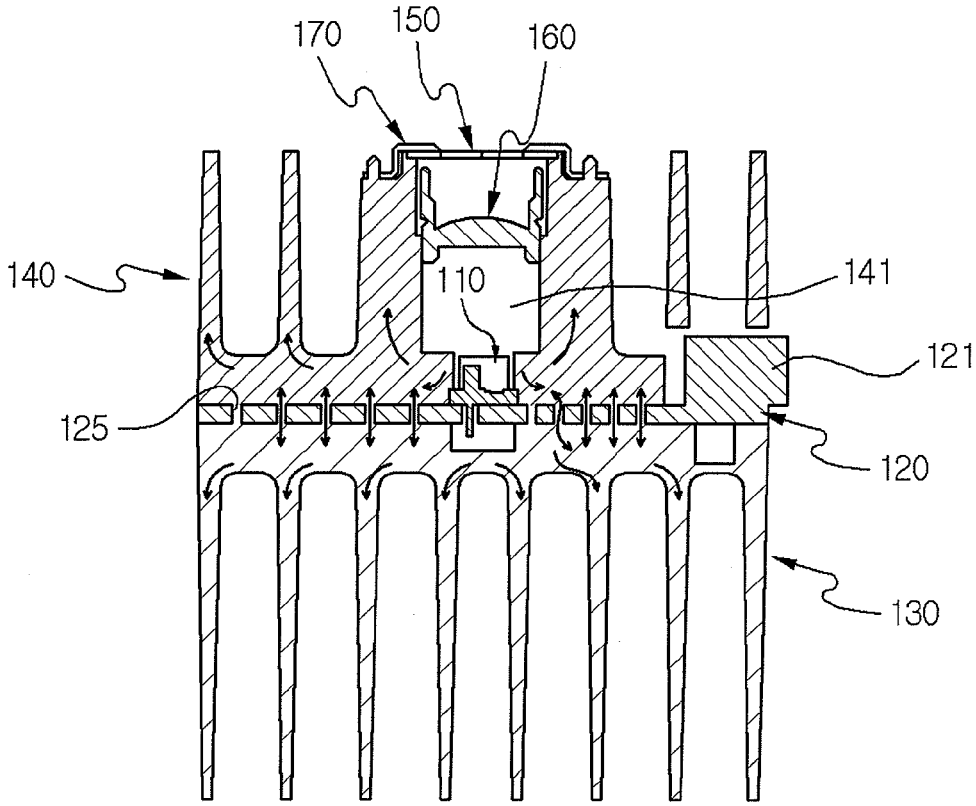
FIG. 6 is a cross-sectional view taken along line A-A' of FIG. 1.

FIG. 6 is a cross-sectional view taken along line A-A' of FIG. 1.

Referring to FIGS. 2 and 6, the upper heat sink 140 is fastened to the top of the substrate 120 and dissipates heat generated by the laser diode 110 to the outside. A light channel 141 in which the laser diode 110 is inserted is disposed through the upper heat sink 140. The light channel 141, which is disposed through the center of the bottom and the center of the top of the upper heat sink 140, fixes the laser diode 110 and provides a space allowing the light emitted from the laser diode 110 to emit out of the upper heat sink 140.

The lower portion of the light channel 141 may function as a holder that fixes the laser diode 110. Accordingly, the lower portion of the light channel 141 may be appropriately disposed to fit to the size of the laser diode 110 and a specific structure for coupling may be formed.

A connector seat 142, a recess where the connector 121 is inserted and received, may be disposed on the bottom of the upper heat sink 140 which is brought in contact with the substrate 120.

The phosphor 150 is positioned ahead of the laser diode 110 in the light channel 141. The phosphor 150 can convert the light emitted from the laser diode 110 into white light.

The collimator 160 may be positioned between the laser diode 110 and the phosphor 150 in the light channel 141.

The phosphor holder 170 can fix the phosphor 150 to the top of the upper heat sink 140. In an embodiment, the phosphor holder 170, as illustrated in FIG. 2, may have a slit portion 171 covering the light channel 141 and fastening portions 172 extending from the slit portion 171. A slit is cut in the slit portion 171. The slit of the slit portion 171 may be designed in the size making the optical efficiency the highest when white light is made by reaction of the light from the laser diode 110 with the phosphor 150. Further, the slit of the slit portion 171 may be disposed in a rectangular for easy optical design, similar to the existing automotive light sources such as LEDs and bulbs.

As indicated by the arrows in FIG. 6, the heat generated by the laser diode 110 is dissipated to the outside through the upper heat sink 140 and the lower heat sink 130. In particular, heat can easily transfer between the heat sinks through the substrate 120 with the first heat conduction layer 123 and the second heat conduction layer 124, and more heat can transfer between the upper heat sink 140 and the lower heat sink 130 through the heat transfer holes 125.

As described above, the embodiments have been described and illustrated in the drawings and the specification. The embodiments were chosen and described in order to explain certain principles of the invention and their practical application, to thereby enable others skilled in the art to make and utilize various embodiments of the present invention, as well as various alternatives and modifications thereof. As is evident from the foregoing description, certain aspects of the present invention are not limited by the particular details of the examples illustrated herein, and it is therefore contemplated that other modifications and applications, or equivalents thereof, will occur to those skilled in the art. Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. An automotive lamp module comprising:

a substrate comprising a substrate body having an upper surface and a lower surface facing away from the upper surface;

a laser diode installed onto the substrate over the upper surface;

a lower heat sink coupled to the substrate over the lower surface;

an upper heat sink coupled to the substrate over the upper surface;

a light channel guide disposed through the upper heat sink and aligned with the laser diode to provide a light channel from the laser diode;

a phosphor disposed in alignment with the light channel, a power connector integrated with the substrate body;

an upper heat conduction layer formed over the upper surface of the substrate body;

a lower heat conduction layer formed over the lower surface of the substrate body; and a power supply circuit pattern formed over the lower surface of the substrate body and electrically connected to the power connector, wherein the lower heat conduction layer is formed over an area except where the power supply circuit pattern is formed, wherein at least one through hole is formed through the upper heat conduction layer, the substrate body, and the lower heat conduction layer.

2. The automotive lamp module of claim 1, further comprising collimator disposed between the laser diode and the phosphor such that the collimator is in alignment with the light channel.

3. The automotive lamp module of claim 1, further comprising:

a phosphor holder coupled to the upper heat sink and for fixing the phosphor to the upper heat sink.

4. The automotive lamp module of claim 1, wherein the light channel guide is configured to hold the laser diode.

5. An automotive lamp module comprising:

a substrate comprising a substrate body having an upper surface and a lower surface facing away from the upper surface;

a laser diode installed onto the substrate over the upper surface;

a lower heat sink coupled to the substrate over the lower surface;

an upper heat sink coupled to the substrate over the upper surface;

a light channel guide disposed through the upper heat sink and aligned with the laser diode to provide a light channel from the laser diode;

a phosphor disposed in alignment with the light channel; and a phosphor holder coupled to the upper heat sink and for fixing the phosphor to the upper heat sink, wherein the phosphor holder has a slit portion with a slit aligned with the light channel and fastening portions extending from the slit portion.

6. The automotive lamp module of claim 5, further comprising:

an upper heat conduction layer disposed over the upper surface of the substrate body at the region except for the power supply circuit patter on the top of the substrate body; and a lower heat conduction layer disposed over the lower surface of the substrate body, wherein at least one heat transfer hole is disposed through the upper heat conduction layer, the substrate body, and the lower heat conduction layer.

7. The automotive lamp module of claim 6, wherein the laser diode is disposed at a central area of the upper surface, wherein the power connector is disposed at a central portion of an edge of the substrate body.

8. The automotive lamp module of claim 7, wherein the substrate body and the upper heat sink, in combination, provide a recess to receive at least part of the power connector.

* * * * *